United States Patent [19]

Su

[11] Patent Number: 4,726,472

[45] Date of Patent: Feb. 23, 1988

[54] DISPOSABLE ASHTRAY

[76] Inventor: Michael Su, 3F, No. 24, Nong 82, Ln. 241, Ching Ping Rd., Chung Her Shyh, Taipei Hsien, Taiwan

[21] Appl. No.: 850,572

[22] Filed: Apr. 11, 1986

[51] Int. Cl.[4] ..... B65D 43/22; A24F 19/02

[52] U.S. Cl. ..... 206/567; 131/242; 220/405; 229/125.37; 229/194

[58] Field of Search ..... 131/174, 219, 220, 231, 131/232, 235, 238, 239, 240.1, 242, 242.6; 206/567, 620, 628; 220/405; 229/44 R, 194, 904

[56] References Cited

U.S. PATENT DOCUMENTS

| | | | |
|---|---|---|---|
| D. 153,687 | 5/1949 | Hoag | 206/567 |
| 1,172,411 | 2/1916 | Von Kaenel | 131/240.1 |
| 2,439,959 | 4/1948 | Anderson, Jr. | 229/44 R |
| 2,506,962 | 5/1950 | Madan | 131/240.1 |
| 3,281,051 | 10/1966 | O'Brien et al. | 206/628 |
| 3,286,909 | 11/1966 | Scharre | 206/628 |
| 3,389,852 | 6/1968 | Egli | 206/628 |

*Primary Examiner*—Jimmy G. Foster

*Attorney, Agent, or Firm*—Lowe, Price, Leblanc, Becker & Shur

[57] ABSTRACT

This invention relates to a disposable ashtray and in particular to one including a body portion and a corrugated tray both made of tinned paper. The ashtray is characterized in that the cigarette can be placed slantwise in the body portion without being extinguished on account that the corrugated tray may afford sufficient air thereto. Further, the ashtray may prevent the tobacco ash from dropping out thereof and may be disposed of after use.

3 Claims, 7 Drawing Figures

DISPOSABLE ASHTRAY

BACKGROUND OF THE INVENTION

This invention relates to a disposable ashtray.

It is well known that conventional tobacco ashtrays are generally made of metal, plastics and glass. With reference to FIG. 7, there is shown a conventional tobacco ashtray. As illustrated, the ashtray 200 is formed at the central portion with a recess 201. Spaced apart on the top surface of the ashtray 200 are a number of notches 202 for receiving the cigarette such that the tobacco ash thereof may be collected in the recess 201. However, it has the following five drawbacks:

1. Since the head of the cigarette is placed at a higher position that the recess 201, the tobacco ash is liable to drop out of the ashtray 200.

2. Since the inner bottom surface of the ashtray is flat, the cigarette will be easily extinguished on account of insufficient air convection if it is placed slantwise in the ashtray 200.

3. Even if the cigarette is placed in the notch 202, the cigarette will often become extinguished when the cigarette burns to the notches 202 because of lacking adequate air.

4. The cigarette is easily dropped down on the table top thereby being liable to cause fire accident.

5. It is necessary to clean after use.

Therefore, it is an object of the present invention to provide a disposable ashtray which may mitigate and obviate the above-mentioned drawbacks.

SUMMARY

It is the primary object of the present invention to provide an ashtray which may be disposed of after use.

It is another object of the present invention to provide a disposable ashtray which is designed so that the cigarette may be positioned slantwise in the ashtray.

It is still another object of the present invention to provide a disposable ashtray which will not drop out thereof.

It is still another object of the present invention to provide a disposable ashtray which is used for receiving tobacco ash.

It is still another object of the present invention to provide a disposable ashtray which is economic to produce.

It is a further object of the present invention to provide a disposable ashtray which is convenient for transportation.

Various objects, features and attendant advantages of the present invention will be more fully appreciated as the same becomes better understood from the following detailed description of the present invention when considered in connection with the accompanying drawings, in which:

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
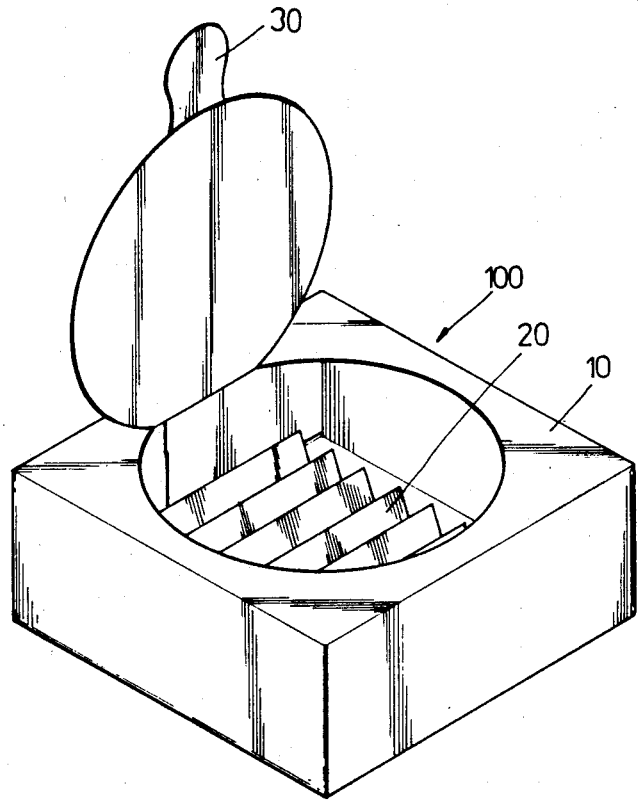
FIG. 1 is a perspective view of a disposable ashtray according to the present invention.
Figure 2:
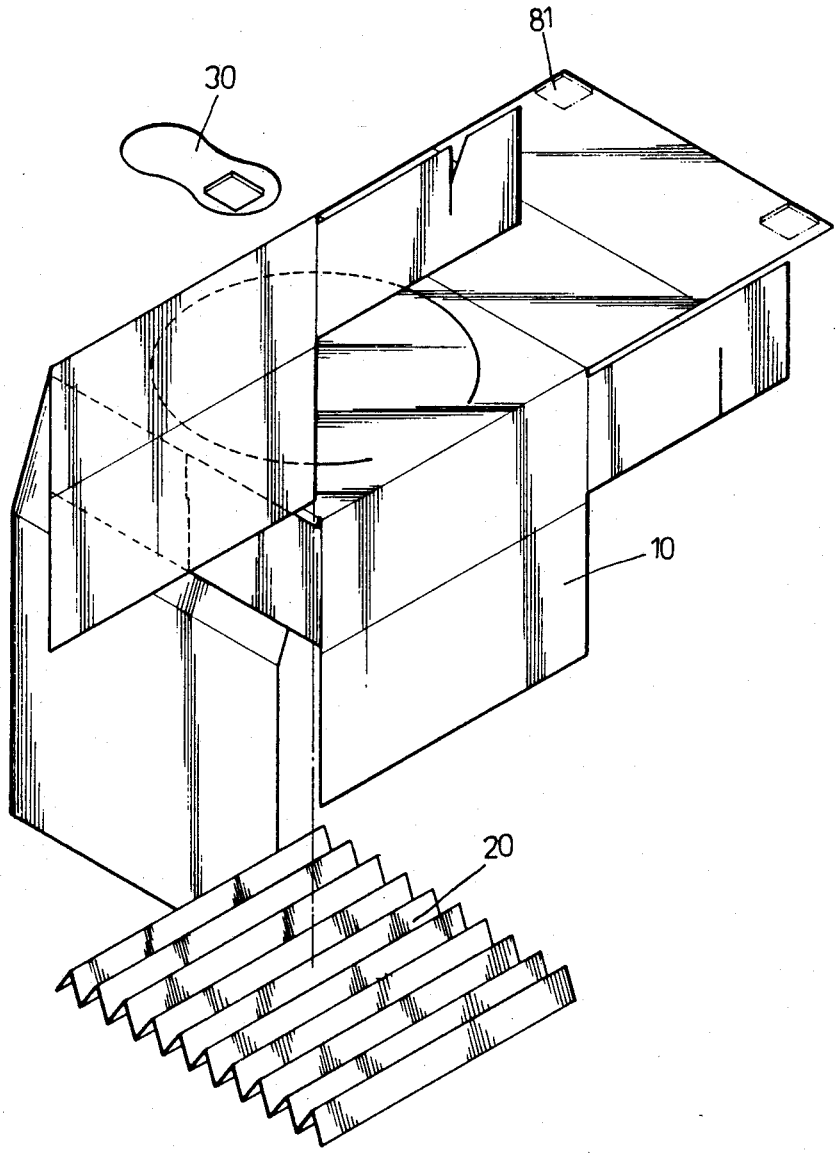
FIG. 2 is an exploded view of the disposable ashtray.
Figure 3:
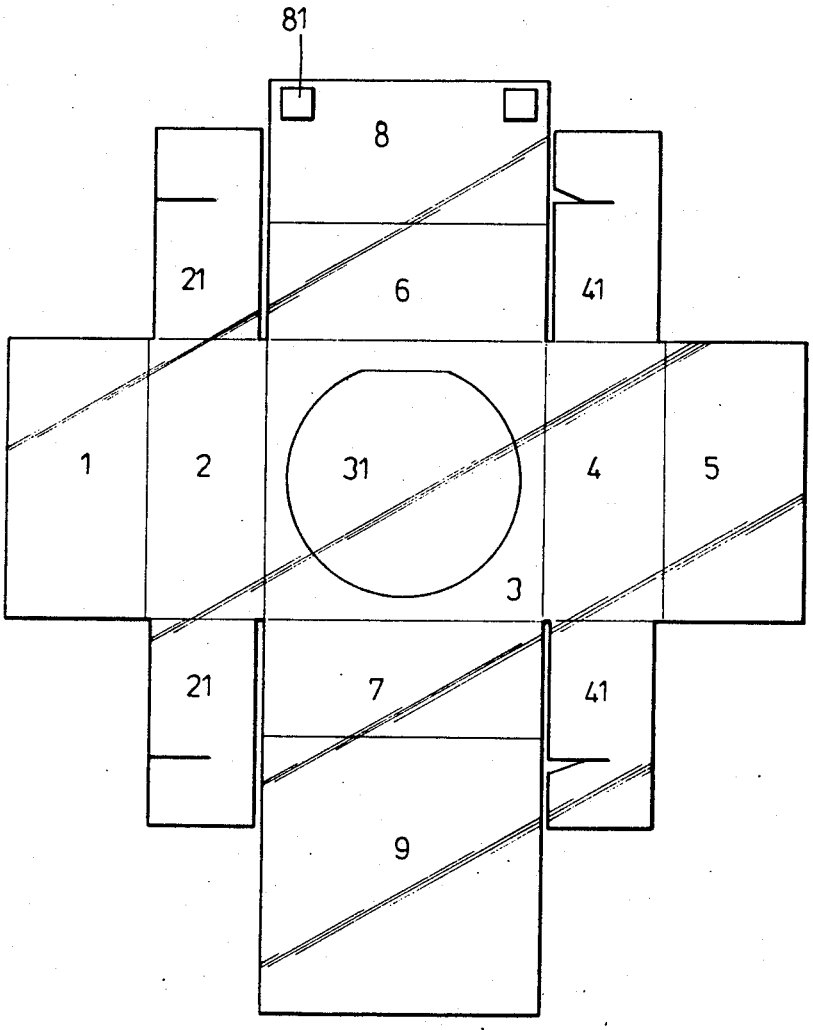
FIG. 3 is a developed view of the body portion of the ashtray.
Figure 4:
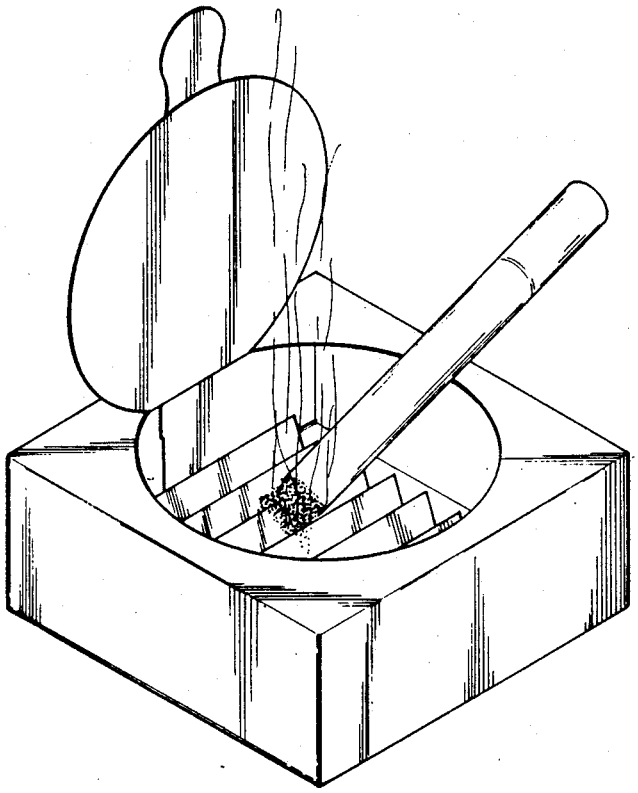
FIG. 4 shows an application of the ashtray.

With reference now to the drawings and in particular to FIGS. 1, 2 and 3 thereof, the disposable ashtray 100 according to the present invention comprises a body portion 10, a corrugated tray 20 and a sticker 30 which are all made of tinned paper. As illustrated in FIG. 3, the body portion 10 includes a first rectangular panel 1, a second rectangular panel 2, a third rectangular panel 3, a fourth rectangular panel 4 and a fifth rectangular panel 5 hingedly connected together in series along mutually parallel edges of said panels so as to be foldable at said edges. The third panel 3 has a circular cover 31 attached to one side thereof. The second panel 2 is provided at two sides with a side panel 21. The fourth panel 4 has at two sides a side panel 41 engageable with a corresponding side panel 21. The side panels 21 and 41 are foldable respectively along the connection with the second panel 2 and the fourth panel 4.

A sixth rectangular panel 6 and a seventh rectangular panel 7 extends from two other sides of the third rectangular panel 3. Hingedly connected with the sixth rectangular panel 6 is an eighth rectangular panel 8 having adhesive means 81 on the bottom thereof. A bottom panel 9 is hingedly connected with the seventh rectangular panel 7 and stuck to the eighth rectangular panel 8 by the adhesive means 81.

The present invention is further characterized by a corrugated tray 20 which is placed on the bottom sot that the cigarette can be positioned slantwise in the ashtray 100 without burning down on account of lacking adequate air convection. A sticker 30 is adhered on the circular cover 31 thereby facilitating the opening of the ashtray 100.

Figure 5:
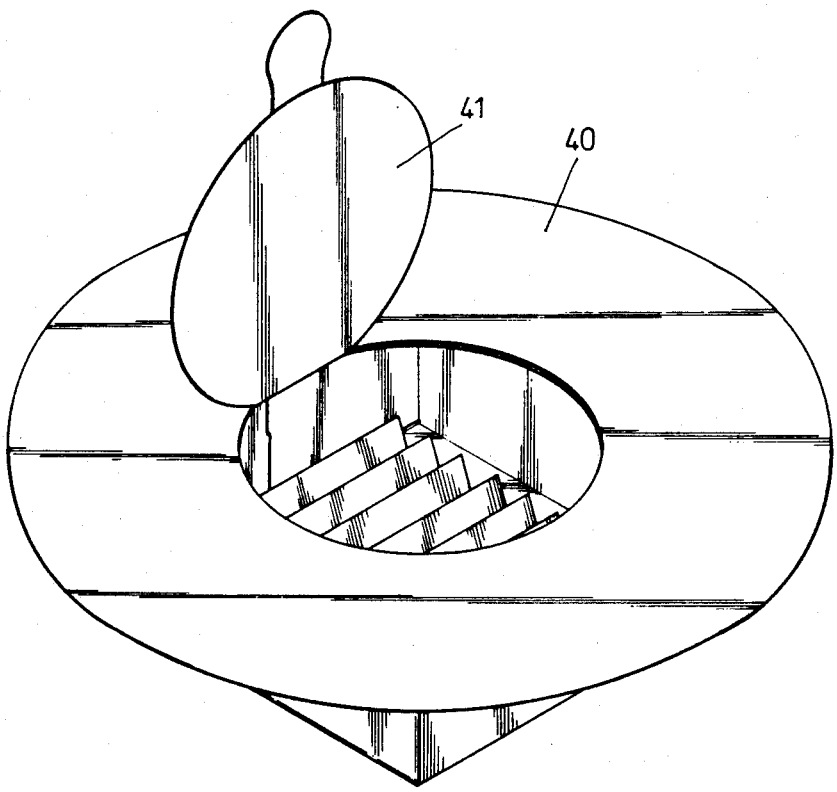
FIG. 5 is a perspective view of a second preferred embodiment of the ashtray.
Figure 6:
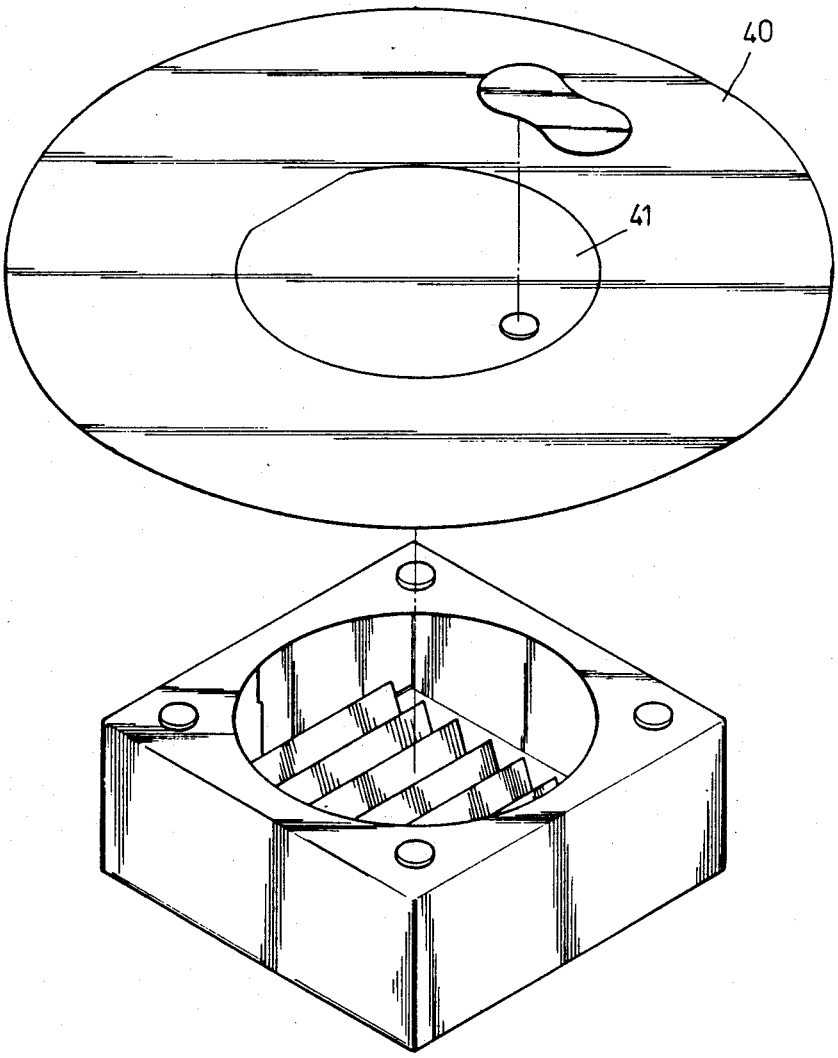
FIG. 6 shows an exploded view of the second preferred embodiment of the ashtray.
Figure 7:
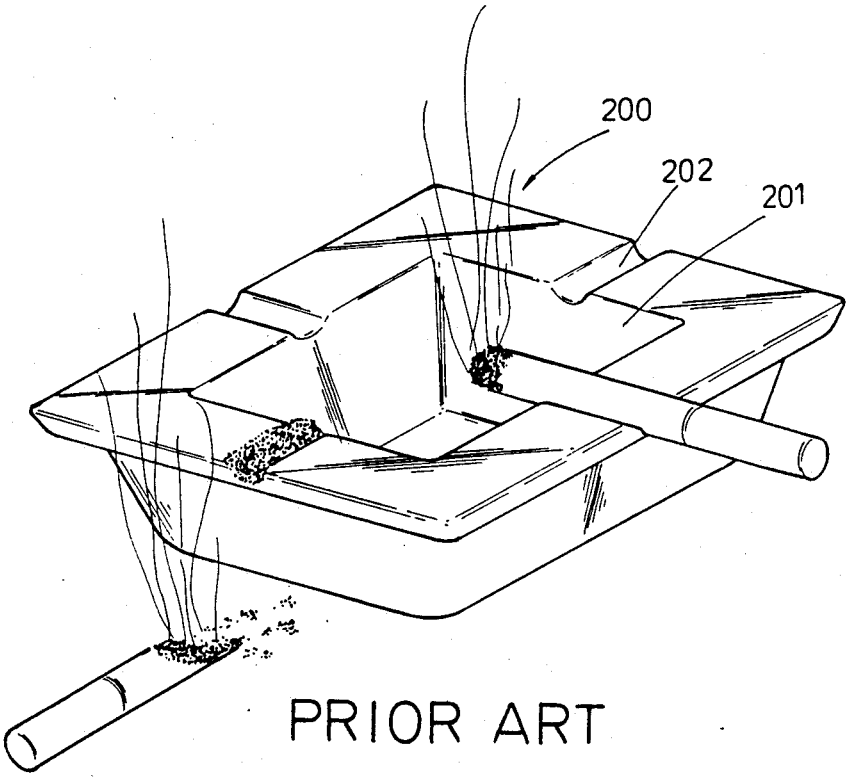
PRIOR ART FIG.7
FIG. 7 sows a conventional ashtray.

With reference to FIGS. 5 and 6, there is shown a second preferred embodiment of the present invention. As can be seen the ashtray 100 can be used with a top surface plate 40 provided with a circular cover 41 so that the circular cover 31 of the body portion 10 is no longer necessary. The third panel is preferably provided on the top with adhesive means so that the top surface plate 40 may be easily fixed thereon. Similarly, the sticker 30 is simply stuck on the circular cover 41 of the top surface plate 40.

Although this invention has been described with a certain degree of particularity, it is understood that the present disclosure is made by way of example only, and that numerous changes in the detail of construction and the compoment parts may be resorted to without departing from the spirit and scope of the invention as hereinafter claimed.

I claim:

1. A disposable ashtray comprising:

a body portion including a first rectangular panel, a second rectangular panel, a third rectangular panel, a fourth rectangular panel and a fifth rectangular panel hingedly connected together in series along mutually parallel edges of said panels so as to be foldable at said edges, said third panel having a circular cover attached to one side thereof;

four side panels each hingedly connected with one side of said second panel and said fourth panel so as to be foldable at said sides, each said side panel being provided with a notch engageable with a corresponding side panel;

a sixth rectangular panel and a seventh rectangular panel extending from two other sides of said third rectangular panel; an eighth rectangular panel hingedly connected with said sixth rectangular panel and having adhesive means on the bottom thereof;

a bottom panel hingedly connected with said seventh rectangular panel and stuck to said eight rectangular panel by said adhesive means;

a corrugated tray placed on said bottom panel;

and a sticker on the cover of said third rectangular panel for enabling the ashtray to be opened easily.

2. A disposable ashtray comprising:

a body portion including a first rectangular panel, a second rectangular panel, a third rectangular panel, a fourth rectangular panel and a fifth rectangular panel hingedly connected together in series along mutually parallel edges of said panels so as to be foldable-at said edges, said third panel having a circular cover attached to one side thereof and provided on the top with adhesive means;

four side panels each hingedly connected with one side of said second panel and said fourth panel so as to be foldable at said sides, each said side panel being provided with a notch engageable with a corresponding side panel;

a sixth rectangular panel and a seventh rectangular panel extending from two other sides of said third rectangular panel; an eighth rectangular panel hingedly connected with said sixth rectangular panel and having adhesive means on the bottom thereof;

a bottom panel hingedly connected with said seventh rectangular panel and stock to said eight rectangular panel by said adhesive means; and a corrugated tray placed on said bottom panel.

3. A disposable ashtray comprising:

a body portion including a first rectangular panel, a second rectangular panel, a third rectangular panel, a fourth rectangular panel and a fifth rectangular panel hingedly connected together in series along mutually parallel edges of said panels so as to be foldable at said edges, said third panel having a circular cover attached to one side thereof;

four side panels each hingedly connected with one side of said second panel and said fourth panel so as to be foldable at said sides, each said side panel being provided with a notch engageable with a corresponding side panel;

a sixth rectangular panel and a seventh rectangular panel extending from two other sides of said third rectangular panel; and eighth rectangular panel hingedly connected with said sixth rectangular panel and having adhesive means on the bottom thereof;

a bottom panel hingedly connected with said seventh rectangular panel and stuck to said eight rectangular panel by said adhesive means;

a corrugated tray placed on said bottom panel; and a top surface plate attached on the top of said third rectangular panel.

* * * * *